US006363707B2

(12) United States Patent
Junquera

(10) Patent No.: US 6,363,707 B2
(45) Date of Patent: Apr. 2, 2002

(54) METHOD FOR SUPPLYING LIFT AND HYDRAULIC FLUID FOR A GAS TURBINE

(76) Inventor: Steven Patrick Junquera, 564 Sacandaga Rd., Scotia, NY (US) 12302

( * ) Notice: Subject to any disclaimer, the term of this patent is extended or adjusted under 35 U.S.C. 154(b) by 0 days.

(21) Appl. No.: 09/782,296

(22) Filed: Feb. 14, 2001

Related U.S. Application Data

(62) Division of application No. 09/299,272, filed on Apr. 26, 1999.

(51) Int. Cl.[7] ..... F02C 7/06; F02C 7/26
(52) U.S. Cl. ..... 60/39.02; 60/39.08
(58) Field of Search ..... 60/39.02, 39.08, 60/39.141, 39.142; 91/532; 137/599; 244/226; 417/302

(56) References Cited

U.S. PATENT DOCUMENTS 4,020,867 A 5/1977 Sumiyoshi
5,394,696 A 3/1995 Eich et al.
5,722,228 A 3/1998 Lampe et al.

*Primary Examiner*—Louis J. Casaregola

(57) ABSTRACT

The invention is embodied in a closed-cycle lubrication oil system used during turbine start-up to provide both lift oil and hydraulic oil from one system using a single variable volume pump that supplies fluid at a high pressure for lift oil requirements. The pump discharge pressure is reduced, through a pressure regulating/reducing valve, down to hydraulic system demands. During steady-state gas turbine operation, the system provides only a flow of hydraulic oil to position the inlet guide vanes and gas valves as required by the gas turbine controls logic. During gas turbine shut-down, the system again meets both lift oil and hydraulic oil requirements. A second pump is advantageously incorporated in the preferred embodiments of the system to provide 100% redundancy in providing either lift or hydraulic oil.

6 Claims, 3 Drawing Sheets

METHOD FOR SUPPLYING LIFT AND HYDRAULIC FLUID FOR A GAS TURBINE

This is a divisional of application Ser. No. 09/299,272 filed Apr. 26, 1999, now pending.

TECHNICAL FIELD

The present invention relates to systems for high pressure lift for turbine start-up and medium pressure hydraulics for turbine operational control. More particularly, the invention relates to a system for supplying hydraulic fluid for both lift and hydraulic systems of a gas turbine.

BACKGROUND OF THE INVENTION

A Gas Turbine initially at rest must be provided with means to enable the internal 'rotor' to begin its rotation. The rotor initially at rest is supported by 'journal bearings' located at each end of the rotor. The journal bearing surfaces are void of lubrication film when the rotor is at rest. Thus, the rotor will require sufficient break-away torque to begin its motion. This torque is provided by the turbines 'turning gear' which is comprised of an electric motor linked to the rotor through the use of a speed reduction gearbox. This turning gear in itself will not provide sufficient break-away torque to place the rotor in motion if the rotor was initially stationary and sitting on the journal bearing surface. To lower the required break-away torque and enable the turning gear to place the rotor in motion, the rotor is hydraulically lifted off of the journal bearing surface by turbine lubricating oil (normally 25 psi) which has been 'boosted' to a much higher pressure (over 3000 psi) and then jetted into the bottom of the journal bearing.

This boosted high pressure (over 3000 psi) turbine lubrication oil which is jetted into the bottom of the turbine journal bearing is called 'lift oil'. There is a system of valves, pumps, filters, manifolds, and tubing which boosts this lubrication oil to high pressure (over 3000 psi) and then delivers it to the bottom of the turbine journal bearing. This system lifts the rotor off of the journal bearing prior to energizing the turning gear thereby reducing the break-away torque below that provided by the turning gear thus enabling rotation. Since this system lifts the rotor through the use of high pressure hydraulic force provided by the lubrication oil, it is often called a 'lift oil system'.

In order to position various hydraulic actuators required for the gas turbine operation, the gas turbine lubrication oil is boosted to a pressure of 1600 psi. The system of valves, pumps, filters, manifolds, and tubing which boosts this lubrication oil to 1600 psi and then delivers it to various hydraulic actuators is often called the 'hydraulic system'.

Conventionally, both of these systems include complicated manifolds, oil filtration units, and variable volume pumps. Moreover, the standard lift oil system offers no redundancy. Thus, if the pump fails to operate, the gas turbine cannot start up. It has, therefore, been proposed to provide a backup lift oil pump. If a second lift oil pump is provided, however, it must be added to the conventional lift oil system as an option. This leads to significant product variability and the second pump is difficult to install due to limited deckspace availability.

SUMMARY OF THE INVENTION

The invention is embodied in a system that uses a single hydraulic pump to provide the fluid, e.g. oil, for the dual functions of high pressure lift for turbine start-up and medium pressure hydraulics for turbine operational control. By providing lift oil and hydraulic oil from a single system, overall system complexity is minimized. Moreover, in the presently preferred embodiments a second hydraulic pump is provided as a back up to both lift and hydraulic requirements for full system redundancy and reliability. This redundant source of lift oil is provided in the presently preferred embodiments without increasing overall system complexity nor required deckspace, as compared to prior systems.

Thus, in accordance with an embodiment of the invention a combined lift and hydraulic fluid supply system for a gas turbine is provided that includes a first pump for receiving hydraulic fluid from a lubricating fluid system and selectively supplying hydraulic fluid at a first pressure sufficiently high for lift system requirements for a gas turbine, a valve for selectively supplying hydraulic fluid to a lift system for a gas turbine, a first fluid flow line for conducting hydraulic fluid from the first pump to the lift system valve, a second flow line in flow communication with the first flow line for receiving at least portion of the fluid pumped by the first pump for supply to the hydraulic system of the gas turbine, and a first pressure regulating valve in the second flow line for reducing the pressure of the fluid flowing therethrough from the first pressure to a lower, second pressure for gas turbine hydraulic system requirements.

In accordance with a preferred embodiment of the invention, the combined lift hydraulic system also has a second pump for selectively receiving hydraulic fluid from the lubricating fluid system and selectively supplying hydraulic fluid at the first pressure, a third fluid flow line for conducting hydraulic fluid from the second pump to the lift system valve, a fourth flow line for receiving at least portion of the fluid pumped by the second pump for supply to the hydraulic system of the gas turbine, and an inlet valve for selectively directing fluid from the lubricating fluid system to at least one of the first and second pumps.

In a preferred embodiment of the invention, furthermore, the first pump, and second pump when provided, is a dual compensated variable volume pump and the system provides for feedback control of the pump(s) in accordance with lift system requirements.

The invention is further embodied in a method for supplying lift and hydraulic fluid for a gas turbine that includes pumping hydraulic fluid with a first pump at a first pressure, sufficiently high for lift system requirements for a gas turbine, through a first flow line; selectively supplying hydraulic fluid at the first pressure from the first flow line to the lift system of a gas turbine through a first valve; directing at least portion of the fluid pumped by the first pump from the first flow line into a second flow line for supply to the hydraulic system of the gas turbine; and reducing the pressure of the fluid flowing through the second flow line from the first pressure to a lower, second pressure for gas turbine hydraulic system requirements.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

The combined lift/hydraulic system embodying the invention is designed to simultaneously provide both high pressure lift oil requirements and medium pressure hydraulic oil requirements from a single variable volume pump. As will be apparent from a consideration of the system embodiments disclosed hereinbelow, the overall combined system is much less complex than that which currently exists by virtue of separate lift oil and hydraulic oil systems. Moreover, the presently preferred embodiments of the combined system provide additional lift oil capability (redundancy) without the use of an add-on pump. By incorporating redundancy in the system, there is reduced product variability, reduced system complexity, and increased system functionality with an overall reduction in required deckspace for the combined system. This has been accomplished in an exemplary embodiment by utilizing two of the conventional system lift oil pumps and a slightly larger electric motor, suitable to meet the additional oil demand. The hydraulic pumps of the prior art system have been eliminated through the use of a pressure regulator valve to reduce the additional oil demand. The hydraulic pumps of the prior art system have been eliminated through the use of a pressure regulator valve to reduce the high pressure lift oil pump discharge to the hydraulic system pressure requirements.

Figure 1:
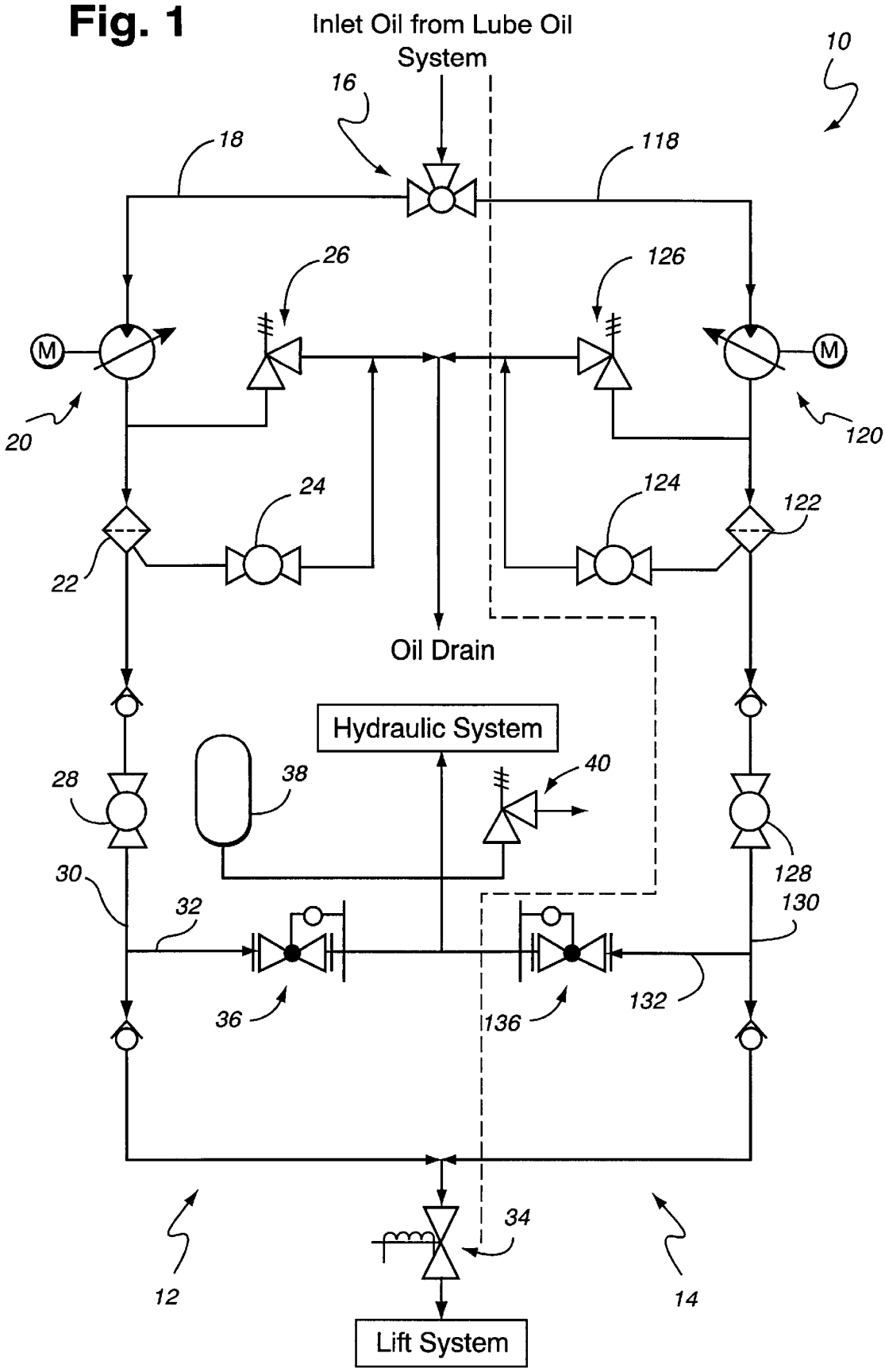
FIG. 1 is a schematic representation of a combined lift/hydraulic system embodying the present invention.

Turning now to FIG. 1, a combined lift/hydraulic oil supply system 10 embodying the invention is schematically illustrated. As illustrated, the combined lift/hydraulic system provides for 100% redundancy. For convenience and ease of description, reference will be made herein primarily to the flow lines and components depicted to the left in the schematic representation of FIG. 1, as the main or primary system 12, whereas the flow lines and components depicted on the right in this schematic representation will be referred to as the redundant or backup system 14. For ease of correlation, parts of the redundant system that correspond to those in the main system 12 are identified with corresponding reference numerals.

Inlet oil from the lube oil system (not shown in detail) enters the combined lift/hydraulic system through inlet transfer valve 16, which directs the oil to the main system 12 and/or redundant system 14. Assuming the inlet transfer valve 16 is disposed for directing inlet oil into the main system 12, the oil flows through line 18 to variable volume pump 20. Pump 20 is a 100% capacity variable volume pump, e.g. 21 GPM minimum @ 5000 psi. By 100% capacity what is meant is that the pump is 100% capable of providing both lift oil and hydraulic oil requirements during start-up or shutdown, and 100% of hydraulic requirements during normal steady-state turbine operation.

An oil filter 22 is provided downstream from variable volume pump 20. Filter 22 is a 100% capacity in-line full flow filtration unit meeting hydraulic oil system requirements. In this regard, it is noted that the hydraulic system filtration requirements are more stringent than those for the lift oil system. In case of flow obstruction at the filter 22, an overpressurization relief valve 26 is provided upstream of the filter 22. A drain valve 24 is also provided, e.g. downstream of the filter 22, for draining oil from the lines in anticipation of system maintenance.

Isolation valve 28 allows this pump circuit 12 to be secured for maintenance while the other pump circuit 14 is in operation, as detailed hereinbelow. Downstream from valve 28, the flow line 30 branches so that oil is supplied to the hydraulic system, via flow line 32, and, when needed, to the lift system, via valve 34. In the illustrated example, valve 34 is a solenoid operated valve for lift isolation, but another valve, such a piloted valve may be provided therefor. On route to the hydraulic system, the pump discharge pressure is reduced in flow line 32 from the higher lift oil pressure to the lower hydraulic oil system pressure requirements, through pressure regulating/reducing valve 36. Downstream from the pressure reducing valve 36, sudden changes in the hydraulic system demands are accommodated by hydraulic accumulator 38 and relief valve 40 will relieve excess pressure in case of overpressurization.

As can be seen, the redundant section 14 of the system 10 mirrors the primary section 12 by providing pump inlet line 118, variable volume pump 120, oil filter 122, drain valve 124, pressure relief valve 126, isolation valve 128, flow lines 130 and 132, and pressure regulating/reducing valve 136, for collective use in lieu of the corresponding components of the primary system 12.

At gas turbine start-up, then, the variable volume hydraulic pump 20, set at lift oil discharge pressure, is started and the lift oil solenoid operated (or piloted) valve 34 is opened to provide high pressure lift oil to the lift orifices. Simultaneously, some of the flow is routed via line 32 to the hydraulic system to position the inlet guide vanes and gas valves. As noted above, the pump discharge pressure is reduced from the lift oil discharge pressure down to the hydraulic system requirements by pressure reducing valve 36, while any sudden changes in hydraulic system demands are accommodated by the hydraulic accumulator 38.

Whenever the gas turbine is above 1% speed, the lift oil is not required. Therefore, during such steady-state gas turbine operation, the lift oil solenoid operated (or piloted) valve 34 is closed and the system will thus provide hydraulic oil requirements only. As described below with reference to FIGS. 2 and 3, in order to reduce the energy loss across the hydraulic system pressure reducing valve 36 during turbine steady-state operation, the variable volume pump 20 may be dual compensated. This means that the pump discharge pressure may be set to the system demands such that when the high pressure lift oil is not required, the pump will drop its discharge pressure to that required by the hydraulic oil system. There are industry standard methods of accomplishing the required pump dual compensation through the use of system hydraulic feedback circuits. Two presently preferred methods are discussed below with reference to the embodiments of FIGS. 2 and 3. With these embodiments, when it is sensed that lift oil is no longer required, the pump discharge pressure reduces to that required by the hydraulic system and when lift oil is again required, the pump returns to the high pressure discharge setting.

When the gas turbine drops to below 1% speed during gas turbine shut-down, the lift oil solenoid operated (or piloted) valve 34 will open again. Simultaneously, some of the flow will continue to be routed to the hydraulic system via line 32 and the pressure reducing valve 36 to position the inlet guide vanes and gas valves.

As is apparent from the foregoing, system discharge pressure is regulated by the high pressure pump 20 being set for the lift oil system and by the hydraulic system pressure reducing valve 36 for the hydraulic system. Thus, no matter what, the pump discharge pressure, the actual hydraulic system pressure is set by the hydraulic system reducing valve 36.

As illustrated, all redundant system features are provided in a secondary loop 14 so that component failures in a failed system loop are compensated for by the backup loop taking over system output requirements automatically through the controls logic.

As noted above, it is not required that the variable volume pumps 20, 120, be dual compensated for the combined lift/hydraulic system of the invention to function. However, providing for dual compensation reduces energy loss across the hydraulic system pressure reducing valve during turbine steady-state operation and thus is incorporated in the presently preferred embodiments of the invention. The particular manner in which dual pump compensation is accomplished, however, is not critical and there are a variety of industry standard methods of accomplishing the required pump dual compensation through the use of system hydraulic feedback circuits. Both of the presently preferred embodiments are load sensing in that they use a hydraulic feedback loop to sense when the lift oil demand exists and the operational pump then aligns to the high pressure discharge setting. When the feedback loop senses that lift oil is not required, the pump switches to the medium pressure setting.

Figure 2:
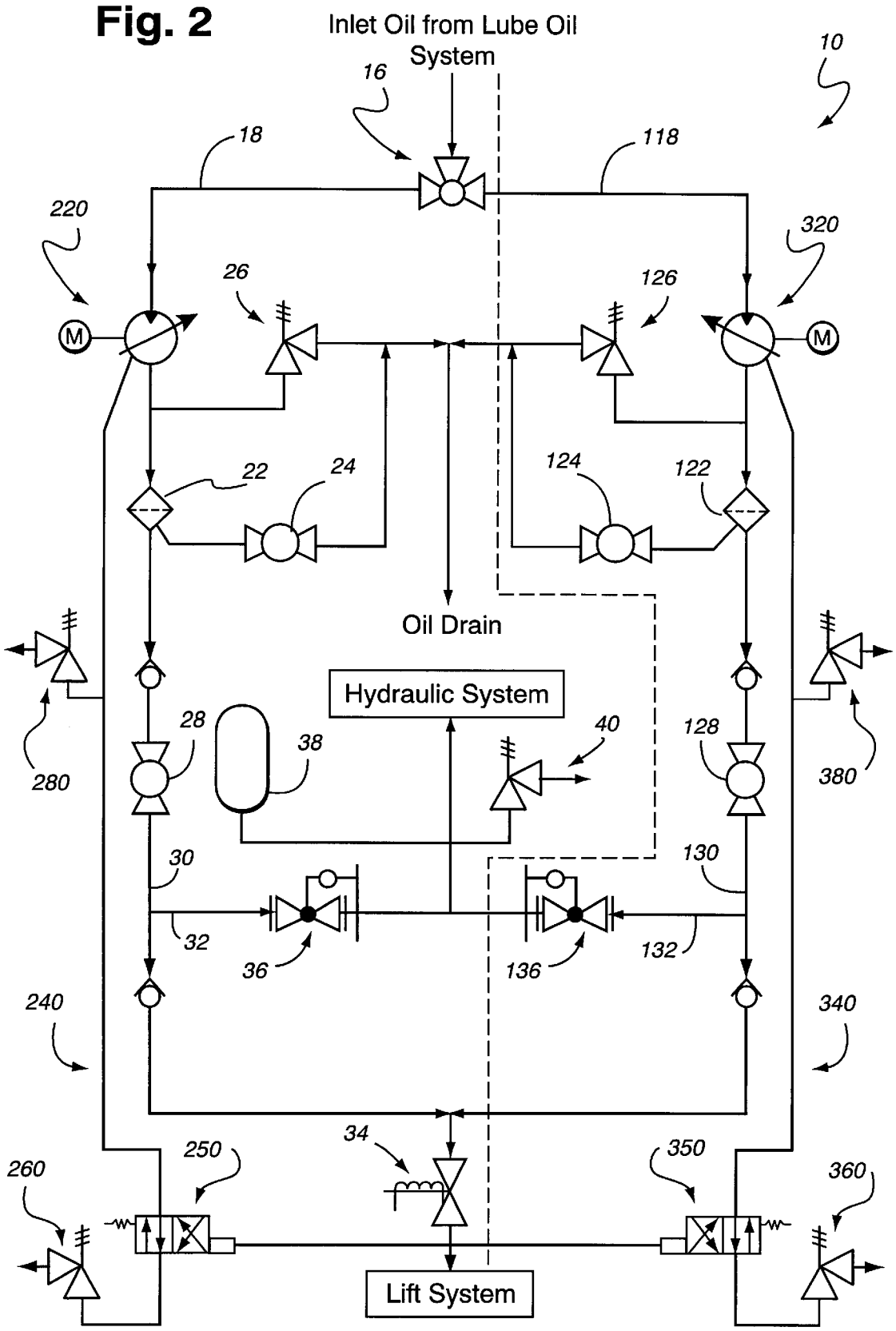
FIG. 2 is a schematic representation of a combined lift/hydraulic system with dual compensated pumps and pilot valve feedback.
Figure 3:
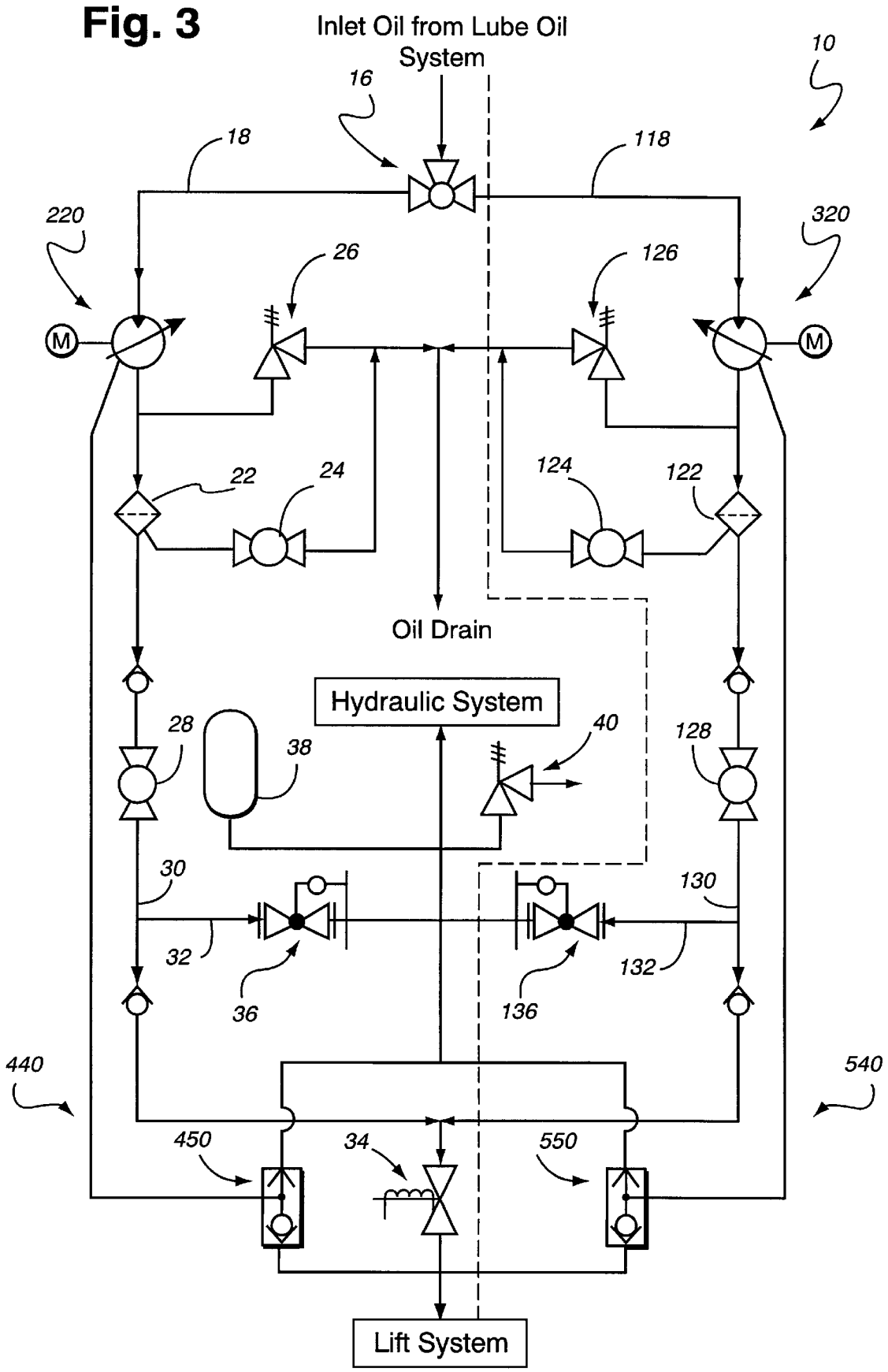
FIG. 3 is a schematic representation of a combined lift/hydraulic system with dual compensated pumps and shuttle valve feedback.

Two different mechanisms for sensing oil lift demands are illustrated, respectively, in FIGS. 2 and 3. In the embodiment illustrated in FIG. 2, pilot actuated valves 250, 350 are provided. In the embodiment of FIG. 3, shuttle check valves 450, 550 are utilized. As noted, a variety of other ways of accomplishing this feedback exists including, for example, the use of another electrically actuated solenoid valve.

Referring to FIG. 2, feedback lines 240, 340 extend respectively from pilot actuated valves 250 and 350 to dual compensated variable volume pumps 220, 320 for feedback controlling the pump in the operational system to high pressure supply when there is lift oil demand and otherwise feedback controlling the pump to medium pressure supply as required by the hydraulic system during steady-state operation. In the illustrated embodiment compensators 260, 360 set at 1600 psi and a compensators 280, 380 set at 3750 psi, for example, are incorporated in the feedback loops 240, 340.

Referring to FIG. 3, shuttle valves 450 and 550 are in flow communication with the output of valve 34 and with the outputs of pressure reducing valves 36, 136, respectively. Feedback lines 440, 540 thus extend respectively from shuttle valves 450 and 550 to dual compensated variable volume pumps 220, 320 for feedback controlling the pump in the operational system to high pressure supply when there is lift oil demand or to medium pressure supply, as required by the hydraulic system during steady-state operation.

In summary and as is apparent from the foregoing, the combined system of the invention provides numerous advantages over conventional systems. Indeed, the combined system reduces the overall number of pumps and components used to accomplish the same lift oil and hydraulic oil demands. For example, the oil pumps and filters of the conventional hydraulic system have been replaced by the use of a pressure regulating valve and solenoid actuated lift isolation valve. Moreover, the provision of a 100% capacity backup pump and flow lines increases standard lift oil system reliability. Finally, in spite of its redundancy the system is more compact and requires less deckspace than the two separate systems presently required.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for supplying lift and hydraulic fluid for a gas turbine comprising:

pumping hydraulic fluid with a first pump at a first pressure through a first flow line, said first pressure being a pressure sufficiently high for lift system requirements for a gas turbine;

selectively supplying hydraulic fluid at said first pressure from said first flow line to a lift system for a gas turbine through a first valve;

directing at least portion of the fluid pumped by said first pump from said first flow line into a second flow line for supply to a hydraulic system for the gas turbine; and reducing a pressure of the fluid flowing through said second flow line from said first pressure to a lower, second pressure for gas turbine hydraulic system requirements.

2. A method as in claim 1, wherein said reducing step comprises reducing the pressure of the fluid flowing through said second flow line with a pressure regulating valve.

3. A method as in claim 1, further comprising filtering fluid pumped by said first pump.

4. A method as in claim 1, further comprising:

providing a second pump; and selectively pumping hydraulic fluid with said second pump at said first pressure through a third flow line for supplying lift system requirements for the gas turbine;

directing at least portion of the fluid pumped by said second pump from said third flow line into a fourth flow line for supply to the hydraulic system for the gas turbine; and reducing a pressure of the fluid flowing through said fourth flow line from said first pressure to the second pressure for gas turbine hydraulic system requirements.

5. A method as in claim 1, wherein said first pump comprises a dual compensated variable volume pump and further comprising feedback controlling said first pump in accordance with lift system requirements to selectively supply fluid at said first pressure during periods of lift oil demand and to supply fluid at a pressure less than said first pressure in the absence of lift oil demand.

6. A method as in claim 4, wherein said second pump comprises a dual compensated variable volume pump and further comprising feedback controlling said second pump in accordance with lift system requirements to selectively supply fluid at said first pressure during periods of lift oil demand and to supply fluid at a pressure less than said first pressure in the absence of lift oil demand.

* * * * *